US009896788B2

(12) United States Patent
Kapsali

(10) Patent No.: US 9,896,788 B2
(45) Date of Patent: Feb. 20, 2018

(54) ACTIVE FIBRE

(71) Applicant: MMT Textiles Limited, Manchester (GB)

(72) Inventor: Veronika Kapsali, London (GB)

(73) Assignee: MMT Textiles Limited, Manchester (GB)

( * ) Notice: Subject to any disclaimer, the term of this patent is extended or adjusted under 35 U.S.C. 154(b) by 0 days.

(21) Appl. No.: 14/408,260

(22) PCT Filed: May 28, 2013

(86) PCT No.: PCT/GB2013/051410
§ 371 (c)(1),
(2) Date: Dec. 15, 2014

(87) PCT Pub. No.: WO2013/186528
PCT Pub. Date: Dec. 19, 2013

(65) Prior Publication Data

US 2015/0140886 A1 May 21, 2015

(30) Foreign Application Priority Data

Jun. 15, 2012 (GB) ..... 1210691.0

(51) Int. Cl.
*D02G 3/44* (2006.01)
*D04H 1/00* (2006.01)
(Continued)

(52) U.S. Cl.
CPC ..... *D02G 3/44* (2013.01); *D01F 8/06* (2013.01); *D01F 8/12* (2013.01); *D02G 3/02* (2013.01); *D02G 3/045* (2013.01); *D03D 15/0027* (2013.01); *D03D 15/0077* (2013.01); *D04H 1/00* (2013.01); *D10B 2321/021* (2013.01); *D10B 2321/022* (2013.01); *D10B 2331/02* (2013.01); *D10B 2401/02* (2013.01); *D10B 2401/04* (2013.01); *D10B 2401/20* (2013.01);
(Continued)

(58) Field of Classification Search
CPC ..... D02G 3/24; D04H 13/002; D04H 13/003
See application file for complete search history.

(56) References Cited

U.S. PATENT DOCUMENTS 4,789,592 A 12/1988 Taniguchi et al.
5,162,074 A 11/1992 Hills
(Continued)

FOREIGN PATENT DOCUMENTS

EP 0 860 521 A2 8/1998
EP 1801274 A1 6/2007
(Continued)

OTHER PUBLICATIONS

Translation of JP 2009-228141, Yasui et al., Oct. 8, 2009, p. 1-21.*

*Primary Examiner* — Hai Vo
(74) *Attorney, Agent, or Firm* — Blank Rome LLP

(57) ABSTRACT

An active fibre comprising material activated by an external stimulus, wherein the fibre has a first configuration in an unactivated state, and in response to activation by the external stimulus the fibre adopts a second, increased twist, configuration, relative to the first configuration, and wherein the fibre can reversibly move between the active state and the unactivated state.

11 Claims, 10 Drawing Sheets

(51) Int. Cl.

| | |
|---|---|
| ***D02G 3/04*** | (2006.01) |
| ***D03D 15/00*** | (2006.01) |
| ***D02G 3/02*** | (2006.01) |
| ***D01F 8/06*** | (2006.01) |
| ***D01F 8/12*** | (2006.01) |

(52) U.S. Cl.
CPC ..... *Y10T 442/3065* (2015.04); *Y10T 442/425* (2015.04); *Y10T 442/629* (2015.04)

(56) References Cited

U.S. PATENT DOCUMENTS

| | | | | |
|---|---|---|---|---|
| 5,336,552 | A | 8/1994 | Strack et al. | |
| 5,534,339 | A | 7/1996 | Stokes | |
| 5,904,982 | A * | 5/1999 | Kent | D01D 5/24 428/373 |
| 6,878,320 | B1 * | 4/2005 | Alderson | D01D 5/08 264/125 |
| 2002/0012794 | A1 * | 1/2002 | Hoyt | D01F 8/06 428/373 |
| 2002/0074697 | A1 | 6/2002 | Steinke et al. | |
| 2008/0132133 | A1 * | 6/2008 | Yasui | A41B 17/00 442/200 |
| 2008/0185115 | A1 * | 8/2008 | Morton | D21F 7/083 162/201 |
| 2011/0039088 | A1 * | 2/2011 | Lee | B29C 44/357 428/222 |
| 2011/0165470 | A1 | 7/2011 | Dahringer et al. | |

FOREIGN PATENT DOCUMENTS

| | | | |
|---|---|---|---|
| JP | 61019816 | | 1/1986 |
| JP | 2003-82543 | A | 3/2003 |
| JP | 4237880 | B2 | 3/2009 |
| JP | 2009228141 | A * | 10/2009 |
| JP | 5033259 | B2 | 9/2012 |
| JP | 5163617 | B2 | 12/2012 |
| WO | WO 99/46327 | A1 | 9/1999 |
| WO | WO 2006/112336 | A2 | 10/2006 |
| WO | WO 2009/106785 | A1 | 9/2009 |
| WO | WO 2009/132284 | A2 | 10/2009 |

* cited by examiner

ACTIVE FIBRE

The application relates generally to the field of fibre production for use in fabrics. More specifically the application relates to active fibres which may be activated by an external stimulus.

Most natural fibres will react to the environment they are in. For example, it is well known that in a humid environment, fabrics made from natural fibres will tend to absorb moisture and the fibres will swell. This property is often not desired as space between the fibres becomes smaller and the fabric becomes less breathable.

Manufactured fibres may also change their properties according to environment. For example, EP1801274, titled "Woven/Knit fabric including crimped fibre and becoming rugged upon humidification, process for producing the same, and textile product" discloses a crimped filament product that may be woven or knitted into fabric, which becomes rougher when wetted with water. When dry the crimp decreases. The filament is bi-component, and the two components have differing reactions to the ambient humidity. When wet, the filaments have an increase in crimp, making the surface of the fabric rougher. This changes the properties of the fabric. However, this physical change in the fabric properties has limited applications.

WO2009/106785 titled "A material" discloses a material with active elements.

The applicants have realised that it is possible to produce fibres and fabrics with particular desired properties which are activated by specific stimuli.

Figure 1A:
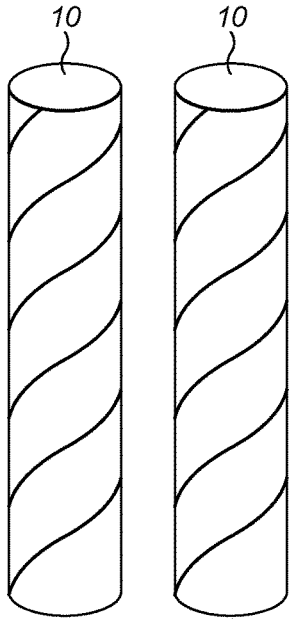
Figure 1B:
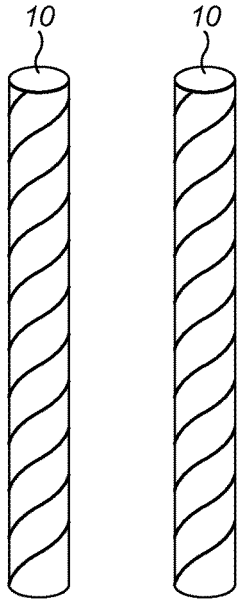
Figure 2A:
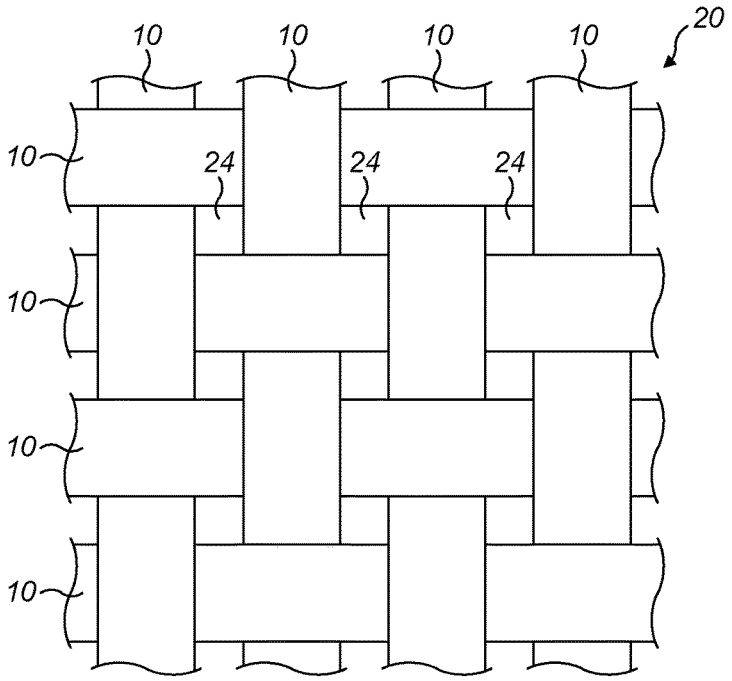
Figure 2B:
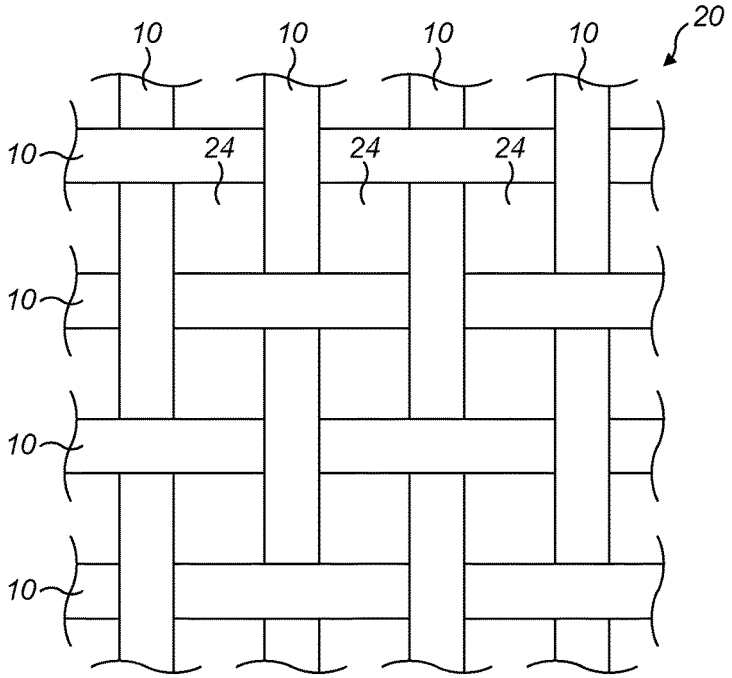
Figure 5:
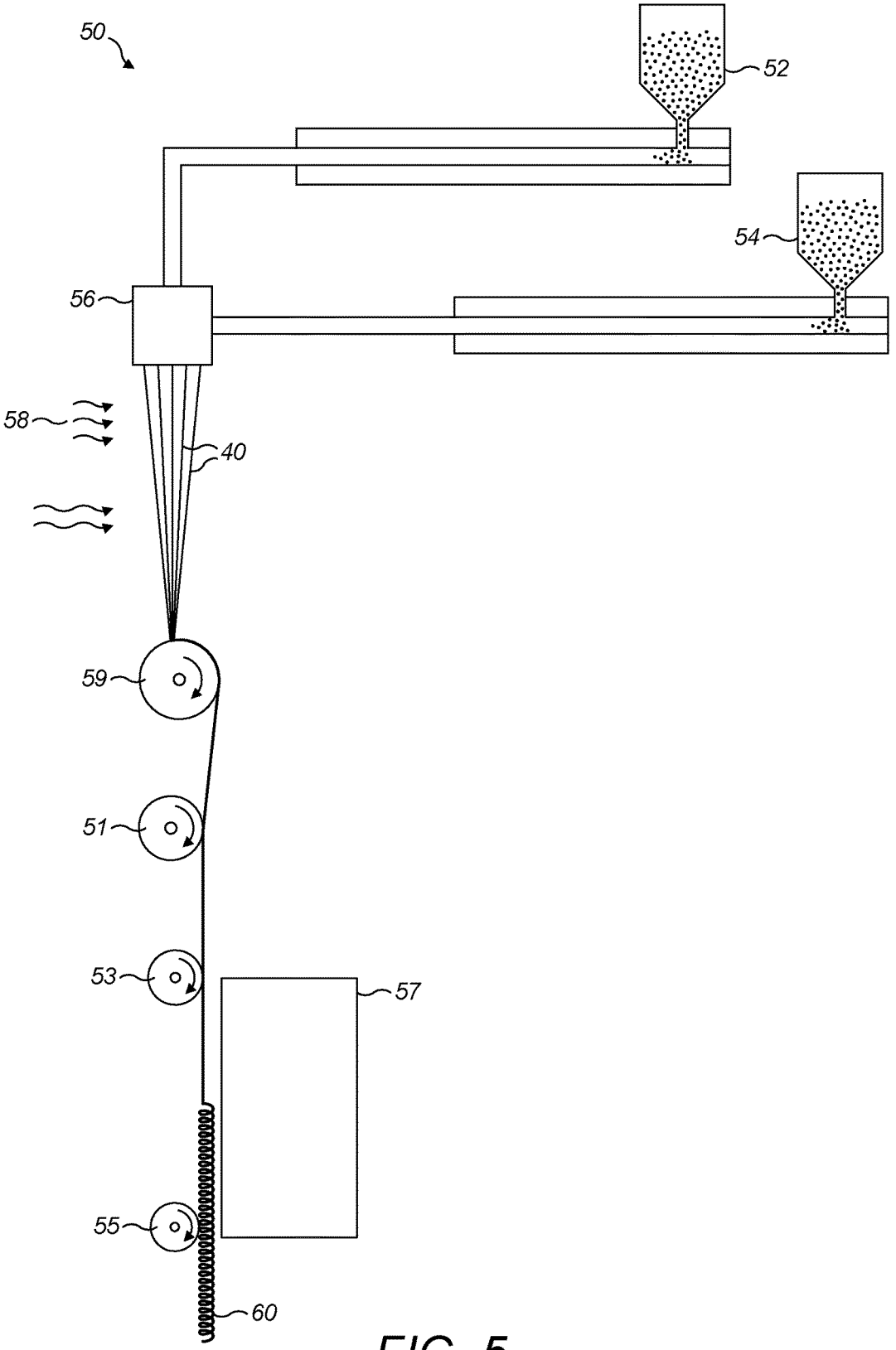
Figure 6A:
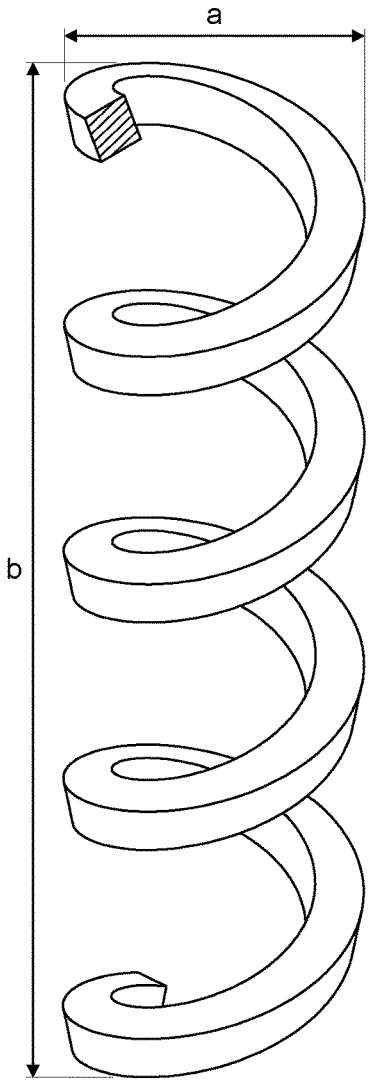
Figure 6B:
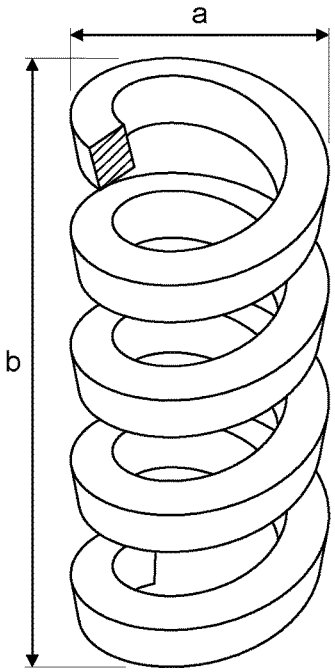
Figure 7A:
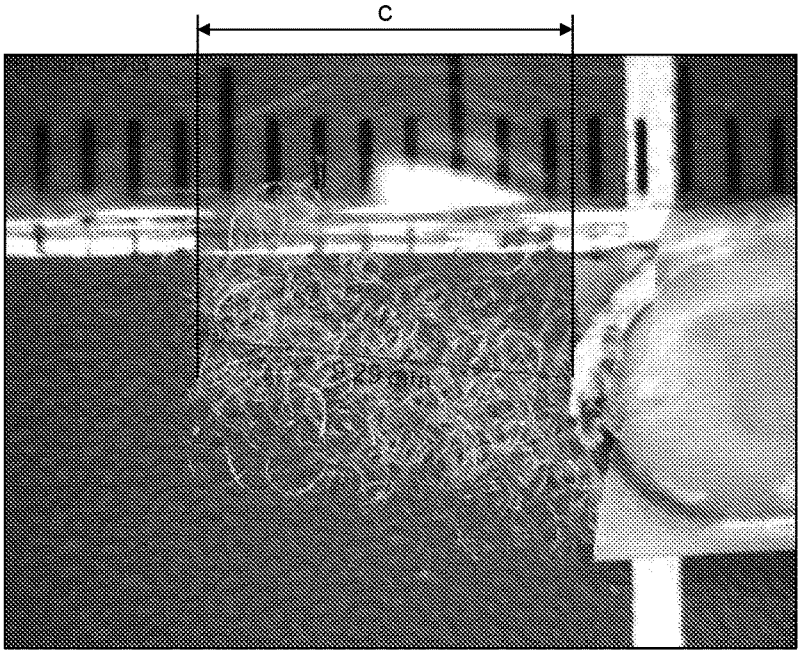
Figure 7B:
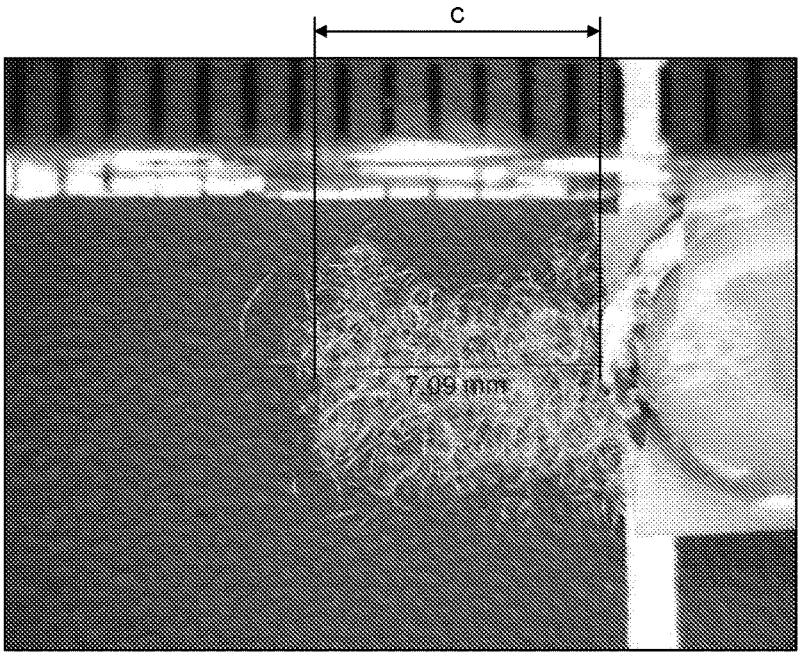
Figure 8A:
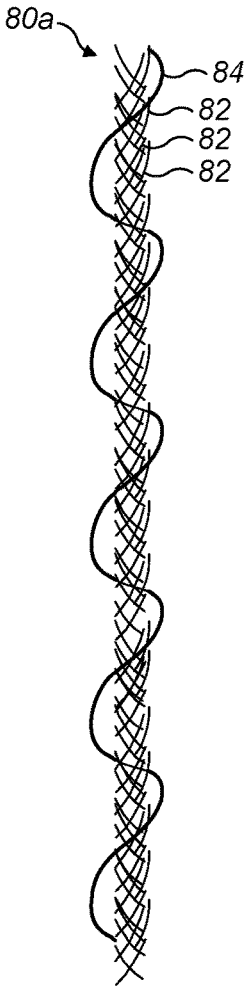
Figure 8B:
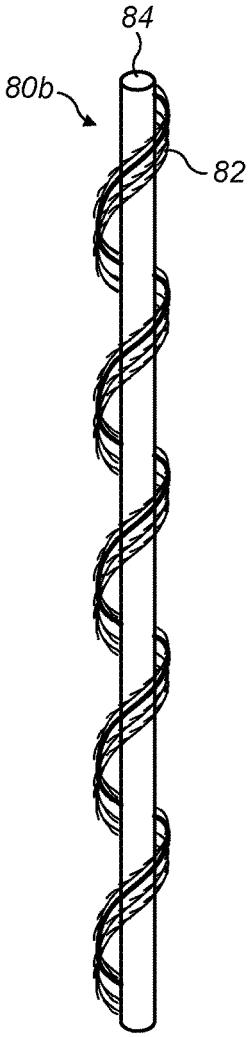
Figure 8C:
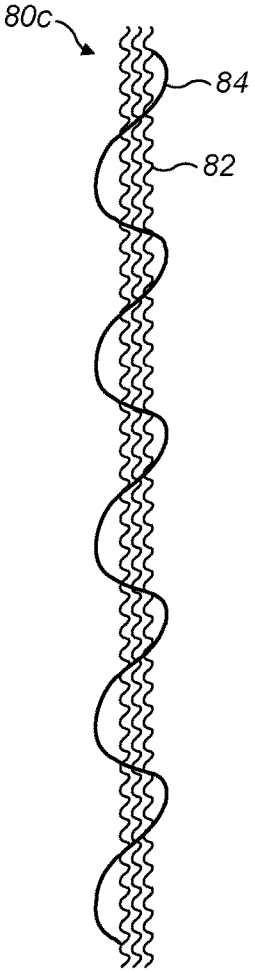
Figure 9:
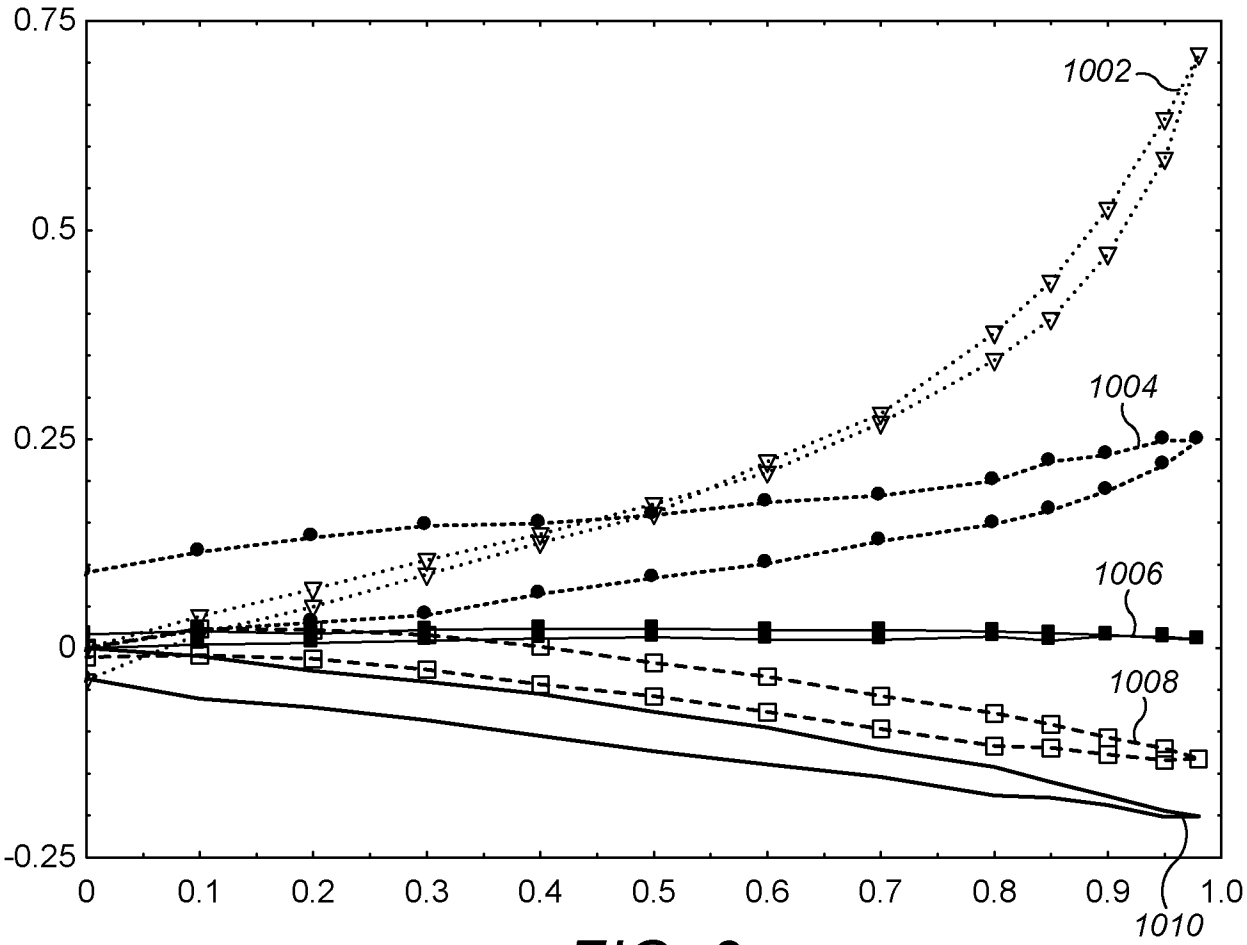
Figure 10A:
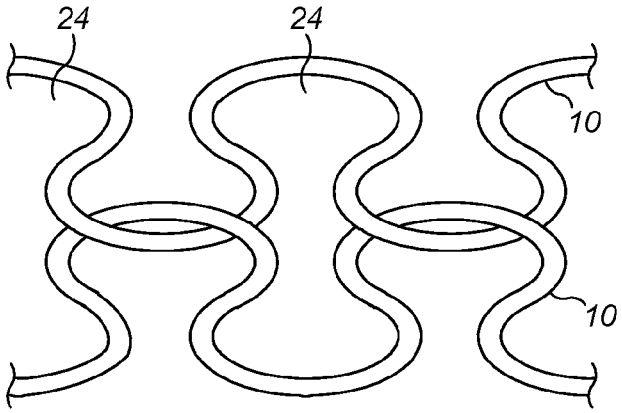
Figure 10B:
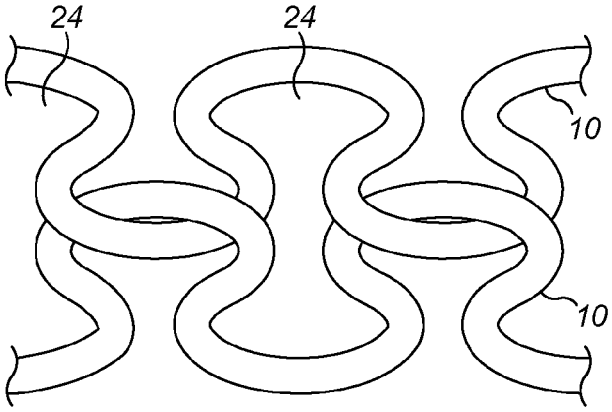
Figure 11:
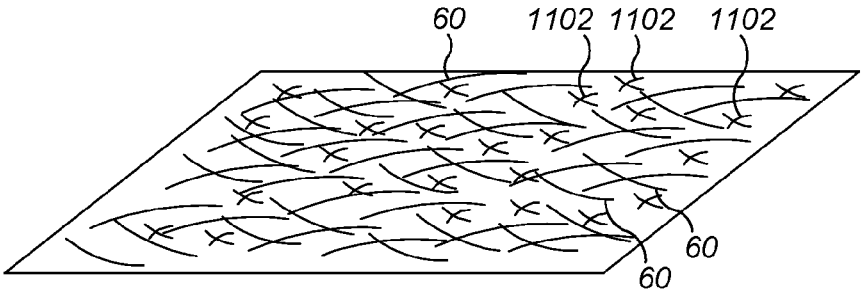

Embodiments of the invention will now be described with reference to the accompanying figures, of which:

FIG. 1*a*: yarn with active fibres, unactivated
FIG. 1*b*: yarn with active fibres, activated
FIG. 2*a*: woven fabric with active fibres, unactivated
FIG. 2*b*: woven fabric with active fibres, activated
FIG. 3*a-d*: fibre cross-sections
FIG. 4*a-e*: bi-component fibre cross-sections
FIG. 5: fibre production apparatus
FIG. 6*a*: active fibre schematic structure, unactivated
FIG. 6*b*: active fibre schematic structure, activated
FIG. 7*a*: active fibre, unactivated
FIG. 7*b*: active fibre, activated
FIG. 8*a*: core spun active yarn
FIG. 8*b*: core spun active yarn
FIG. 8*c*: core spun active yarn
FIG. 9: graph of testing results
FIG. 10*a*: knitted active fabric, activated
FIG. 10*b*: knitted active fabric, unactivated
FIG. 11: non-woven active fabric The invention is set out in the accompanying claims.

In overview, according to embodiments disclosed herein, the properties of a fibre, yarn and or fabric may be engineered such that the material has a particular behaviour when exposed to an external predetermined stimulus or trigger. Activating stimuli are not limited and may be determined through the choice of fibre components. For example, fibres with two chemically differing components may be activated by moisture/humidity, temperature, light, pH, electrical current, force field, microbes, or biological matter. The effect between the activated and unactivated state is reversible.

A single or combination of properties result in a yarn that becomes thinner in cross-section perpendicular to the longitudinal axis of the yarn when exposed to a predetermined stimuli. In a textile system, where the yarn is knitted, woven or otherwise made into a fabric, on exposure to the trigger thermal properties of a fabric contain the yarn change, for example the yarn becomes thinner leaving more space between yarns and thus causing the textile system to reduce its resistance to air flow.

The mechanical structure of the fibres, yarns, and fabric may also lead to differing properties. Fibres may be extruded with different cross-sections such as rectangular, oval, round or demonstrate groves (i.e. tri-lobal). In a bi-component fibre, the components may not be evenly distributed and may be in a range of proportions. Indeed, an asymmetric arrangement may be desirable.

An active fibre comprising material activated by an external stimulus has a first configuration in an unactivated state, and in response to activation by the external stimulus the fibre twists to adopt a second, increased twist, configuration, relative to the first configuration.

An active fibre may be made from a shape-memory material. Preferably the fibre is arranged in a helix and in the second configuration the fibre is arranged in a helix with relatively decreased radius and pitch. This allows for a fibre that is relatively long and wide when unactivated and relatively short and narrow when activated. The fibre may move between the active state and the unactivated state in proportion to the external stimulus, that is to say it can adopt a range of configurations between fully unactivated and fully activated (twisted) configurations, with a corresponding range of dimensions and consequent thermal properties.

The shape-memory material may comprises at least two components having differing physical reaction to the external stimulus. The components may be in a ratio range of 50:50 to 20:80 and may be arranged in side-by-side, sea island or eccentric configuration. Preferably, the fibres have an asymmetric configuration. This is discussed in more detail below.

The fibre may have rectangular, oval, circular or tri-lobal cross section.

Filament fibres may be cut into staple fibres of any appropriate the length which will depend on the use.

In an embodiment, the first material component is 70% Nylon 6 and a second component is 30% polypropylene where the polypropylene provides an off-centre core and the fibre is crimped.

The application also relates to a method of production of active fibres, yarns, fabrics, textiles and other active materials. Yarns may be made from 100% active fibres or may be blended with other fibres. Each of the products is arranged to increase air permeability in an active state. Yarns may be spun using any appropriate approach, for example, air jet, Murata Jet, Ring or core spun methods. Fabrics may be knitted, woven, non-woven, glued, stitched, or bonded. Fabrics suitable for use as an agricultural textiles, building textiles, geo-textiles, domestic or industrial interior textiles, domestic or industrial cover textiles, filters, medical textiles, medial dressing textiles, packaging, or vehicle interior/exterior textiles are envisaged.

Throughout this application, we refer to humidity active fibres by way of example. However, it is envisaged that other stimuli may be used to activate the fibres. Where humidity is the external stimulus, which acts as a trigger, in an active state the fibres are in a humid environment and an active configuration, in an unactive state the fibres are in a dry environment and an unactive configuration.

Turning to aspects in more detail, the concept of the general structure and behaviour of an active yarn may be seen in FIGS. 1*a* and 1*b*. A bundle of spun fibres twisted together provides the body of the yarn 10. The yarn may be spun with 100% staple active fibres or a blend of neutral and active fibres may be used. Further, the yarn may include filament fibres. The active fibres are arranged in the yarn so that they are exposed to the external trigger. In dry conditions, the active fibres are in an unactivated configuration. The yarn 10 has a relatively loose twist and the yarn dimension is relatively broad, as can be seen in FIG. 1*a*. As discussed in more detail below, on exposure to humid conditions, the active fibres shrink, becoming shorter with a narrow cross-section. The yarn 10 becomes more tightly twisted in the activated configuration compared with dry conditions and the yarn dimension becomes narrower, as can be seen in FIG. 1*b*. Hence, active yarns of FIGS. 1*a* and 1*b* may be made into a fabric that becomes more breathable when exposed to humidity.

In FIGS. 2*a* and 2*b* the yarns 10 have been woven to make a fabric 20. Active yarns 10 have been used for both the warp and weft of the fabric. In FIG. 2*a* the woven fabric 20 has relatively small gaps 24 between each of the yarns 10 in dry conditions. The small gaps mean that airflow through the fabric is relatively low.

In humid conditions, the yarns 10 react to the environment and become narrower. This is shown in FIG. 2*b*. The fabric 20 retains its overall dimension, however, the yarns 10 are thinner. Thus, the gaps 24 between each of the yarns 10 become bigger in humid conditions. The larger gaps 24 between the yarns 10 mean that air flow through the fabric is easier. Thus, in humid conditions the fabric 20 becomes more breathable as the configuration of the active yarns 10 allows for increased air flow through the fabric. This is effect is the opposite to the normal behaviour of fabrics. In a common fabric, an increase in humidity would cause a decrease in air flow thought the fabric.

The effect described above in relation to the active fibres can be achieved with a twisted shape-memory fibre. Shape-memory materials are able to retain two or more shapes and transition between those shapes when triggered by an external or environmental stimulus. In the examples described herein, the external stimulus is humidity. It is preferable that the shape-memory material has a relatively quick rate of reacting to the trigger so that it quickly changes from a first shape to a second shape. One way of achieving a shape-memory fibre is to use at least two polymers to make a bi-component fibre.

Further, the fibre may go through a range of transitional shapes. With the example of humidity as a trigger, the humidity may be increased from 0% relative humidity to 100% relative humidity. At 0% humidity the fibre would have a first configuration. A 100% humidity the fibre would adopt a second configuration. In conditions where humidity is between these two extremes the fibre could adopt a number of transitional configurations.

Figure 3A:
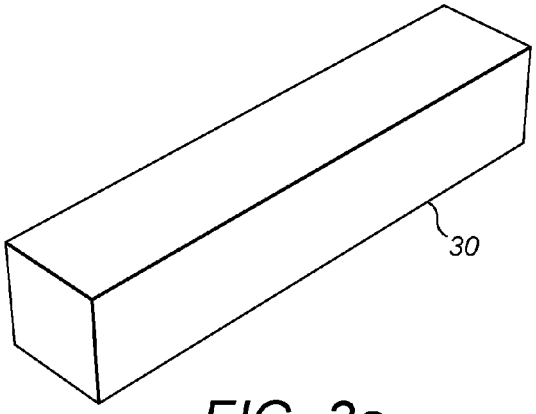
Figure 3B:
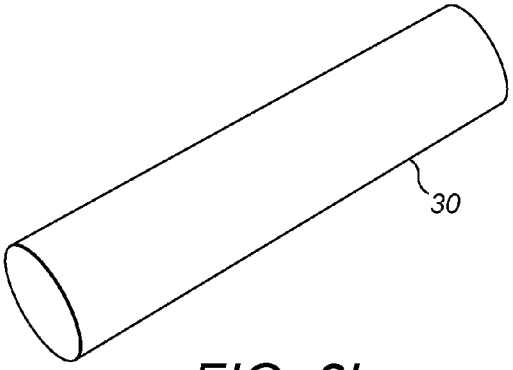
Figure 3C:
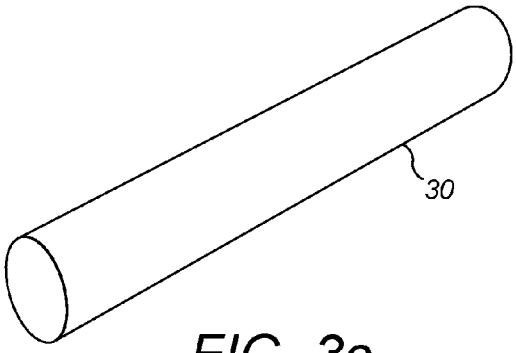
Figure 3D:
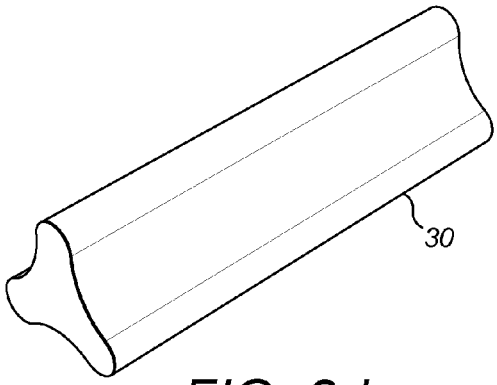
Figure 4A:
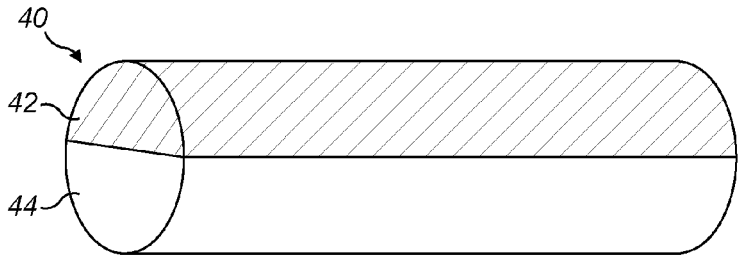
Figure 4B:
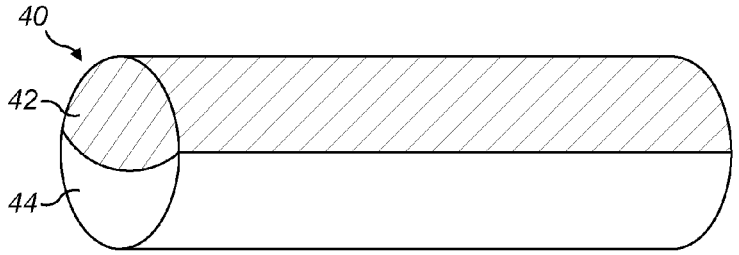
Figure 4C:
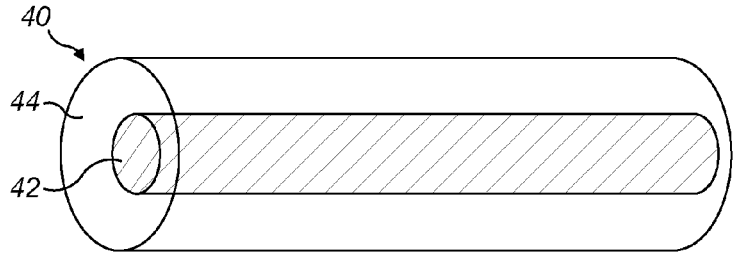
Figure 4D:
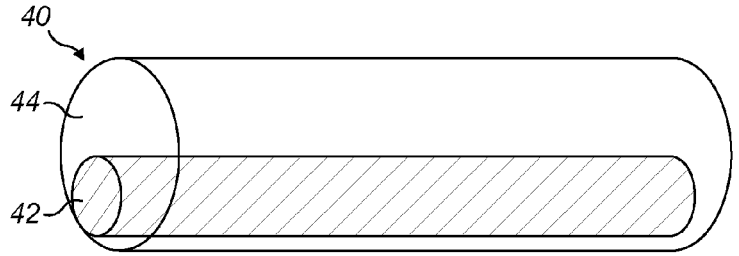
Figure 4E:
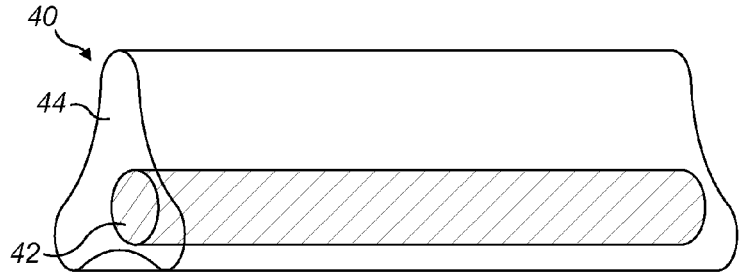

Filament fibres 30 may be manufactured using known processes as will be known to the skilled person such that detailed discussion is not required. Filament fibres may have various cross-sections and provide the functionality described, some of which are shown in FIG. 3. For example, the filament 30 may have a rectangular cross-section (FIG. 3*a*), an oval cross-section (FIG. 3*b*), a circular cross-section (FIG. 3*c*) or a tri-lobal cross-section (FIG. 3*d*). The skilled person will realise that this is not an exclusive list of possible cross-section of fibres. The cross-section of the fibre is determined during the manufacturing and processing of fibres. Further, the skilled person will realise that the cross-section will determine some of the properties of the finished fibres, yarns spun from the fibres and fabrics made from yarns and fibres.

A manner of ensuring that the fibres twist as described in fabrication is to make filament fibres with more than one component. These are usually referred to as bi-component fibres, although, they may contain more than two components. The components are usually combined during the manufacture of the filament fibres, and may be combined in any ratio. The manufacturing process enables various cross-sections to be achieved.

FIG. 4 shows some possible bi-component fibres 40 cross-sections. In FIG. 4*a*, the two components 42, 44 are in a 50:50 ratio and are in a side-by-side arrangement. In FIG. 4*b* the components 42, 44 are in an unequal radio and are in a side-by-side arrangement. Further, the interface between the first component 42 and second component 44 is not planar. In FIGS. 4*c* and 4*d* the components 42, 44 are in a concentric arrangement, where a first component 42 forms a core of the filament 40 and the second component 44 forms a sheath. In both of the examples shown in FIGS. 4*c* and 4*d* the first core component 42 is asymmetrically placed within the sheath 44. In FIG. 4*c* the core 42 is off-centre, and in FIG. 4*d* the core is located on the circumference of the sheath 44. FIG. 4*e* shows a tri-lobal fibre 40. The second component 42 is located on one side of the sheath component 44. The arrangements shown in FIGS. 4*c*-4*e* are also known as "sea island" configurations. The skilled person will understand that these are arrangements are not limited and may include further components or additional "islands".

In overview of the fabrication process, manufactured fibres are often produced in a continuous filament fibre process. Raw materials are extruded through a die and the filaments are then dried and further processed to produce the desired fibres. For example, fibres are often drawn while still molten to orient the polymer molecules and again once solidified to increase the length of the filament. Staple fibres are produced by cutting filament fibres into short lengths. The length of staple fibres will depend on their use.

Extrusion processes for making multi-component fibres are known and need not be described here in detail. Generally, to form a multi-component fibre, at least two polymers are extruded separately and fed into a polymer distribution system wherein the polymers are introduced into a spinneret plate or die. The polymers follow separate paths to the fibre spinneret and are combined in a spinneret hole. The spinneret is configured so that the extrudant has the desired overall fibre cross section (e.g., round, tri-lobal, etc.). The spinneret may be configured to produce single or multiple filament fibres. Such a process is described, for example, in U.S. Pat. No. 5,162,074.

Following extrusion through the die, the resulting thin fluid strands, or filaments, remain in the molten state for some distance before they are solidified by cooling in a surrounding fluid medium, which may be chilled air blown through the strands.

Once solidified, the filaments are taken up on a godet or other take-up surface. In a continuous filament process, the strands are taken up on a godet, which draws down the thin fluid strands from the die in proportion to the speed of the take-up godet. Continuous filament fibre may further be processed into staple fibre. In processing staple fibres, large numbers (e.g., 10,000 to 1,000,000 strands) of continuous filament are gathered together following extrusion to form a tow for use in further processing.

Alternatively, rather than being taken up on a godet, continuous multi-component fibre may also be melt spun as a direct laid, non-woven web via a jet process, to produce a non-woven fabric.

For example, in a spunbonding process, the strands are collected in a jet following extrusion through the die, such as for example, an air attenuator. The strands are then blown onto a take-up surface, such as a roller or a moving belt, to form a spunbond web. Alternatively, in a meltblown process, air is ejected at the surface of a spinneret to simultaneously draw down and cool the thin fluid polymer streams. The streams are subsequently deposited on a take-up surface in the path of cooling air to form a fibre web.

Regardless of the type of melt spinning procedure which is used, the thin fluid streams are typically melt drawn in a molten state (i.e., before solidification occurs) to orient the polymer molecules for good tenacity. Typical melt draw down ratios known in the art may be utilized. The skilled artisan will appreciate that specific melt draw down is not required for meltblowing processes.

When a continuous filament or staple process is employed, it may be desirable to subject the strands to a draw process. In the draw process, the strands are typically heated past their glass transition point and stretched to several times their original length using conventional drawing equipment, such as, for example, sequential godet rolls operating at differential speeds. Typical draw ratios can depend upon polymer type. For example, draw ratios of about 2 to about 5 times are typical for polyolefin fibres. Optionally, the drawn strands may be heat set to reduce any latent shrinkage imparted to the fibre during processing.

If staple fibre is being prepared, following drawing in the solid state, the continuous filaments are cut into a desirable fibre length. The length of the staple fibres generally ranges from about 25 mm to about 50 mm, although the fibres can be much longer or shorter as desired. See, for example, U.S. Pat. Nos. 4,789,592 and 5,336,552. Optionally, the fibres may additionally be subjected to a crimping process prior to the formation of staple.

FIG. 5 shows a typical fibre production apparatus 50, where the raw materials are introduced to the process at 52, 54. These then go into the fibre distribution unit 56 where the polymers are combined and are extracted through a die to produce strands or filament fibres 40. The strands 40 are cooled by air 58 before being taken up on a godet 59. The fibres are then drawn by godet 51 to increase their length and decrease the cross-sectional area. Finally, the fibres 40 are fed by godets 53, 55 through a heated area 57 which causes the filament fibres 40 to transform into a helix configuration fibre 60, for example by crimping.

The activating external stimulus or trigger for the active fibres is determined during the manufacturing of the fibres and fabric and, at least in part, are determined by the chemistry of the components of the fibres.

The activating stimulus can be moisture, temperature, light, pH, electrical current, force field, microbes, biological matter etc. This is not a limited list. The components of the fibres should be selected accordingly.

For example, a minimum of two polymers should be selected to make a bi-component fibre. Where it is required that the fibres are activated by moisture/humidity, the polymers should be selected to have different thermal shrinking properties, Young's modulus and moisture absorption properties. The at least two polymers may be in ratio proportions ranging from 50:50 to 80:20.

For activation by moisture/humidity, the fibres should have a hygroscopic component and a non-hygroscopic component. Co-extruded fibres with a circular cross-section comprising Nylon 6 as the hygroscopic component and polypropylene (PP) as the non hygroscopic component in a ratio 70:30 Nylon:Polypropylene ratio in a eccentric sheath core configuration have been found to have the desired reaction when exposed to moisture/humidity. In production, the fibres were heat set to impose a crimp and cut into staple fibres.

As noted above, in a bi-component fibre, the components may be arranged in a side-by-side, eccentric sheath core or sea island configurations. The cross section is determined, by the polymer distribution unit, the die during the extrusion process and the ratio of components. Ratios may range from 50:50 to 80:20. The shape of the fibres will also effect the mechanical configuration reaction to the activation stimuli.

Further, post-extrusion processing of the fibres may also provide desired mechanical properties. As noted above, it is possible, for example, to introduce a thermoset crimp to the fibres, in either filament or staple form. Crimp may be measured by the number of bends per unit length and the radius of the bend. For example, a fibre with fine crimp, may have many bends with a small radius, whereas a course crimp may have fewer bends with a large radius.

In an example, a yarn made from a staple co-extruded filament fibres with a circular cross-section comprising Nylon 6 as the hygroscopic component and polypropylene (PP) as the non-hygroscopic component in a ratio 70:30 Nylon:Polypropylene ratio in a eccentric sheath core cross-section and with a helical crimp imposed, was found to reduce in overall cross-section dimension, thus providing an increased air flow through the yarns.

The physical mechanism which leads to the reduction in cross-section and shortening of the fibre can be described with reference to FIGS. 6*a* and 6*b*.

A staple fibre, when in a dry environment, has the unactivated configuration shown in FIG. 6*a*. The fibre has a production imposed crimp as discussed above which results in a fibre 60 with a helix shape and a generally oblong form factor, shown in FIG. 6*a* by dimensions a and b.

A helix may be described as a three-dimensional curve around an axis. The pitch of a helix is the length of one complete turn measured along the axis of the helix. A circular helix has a constant curvature and constant torsion.

On exposure to increased humidity, the crimp of the fibre increases, such that the number of bends per length increases and the radius of the bends decreases i.e. the helix becomes tighter, the radius and pitch of the helix decreases, and the fibre is more compact.

Selecting components of the bi-component fibre with differing properties gives rise to the helix structure. The hygroscopic component is selected to have less thermal shrinkage and to be less stiff than the non-hygroscopic polymer. When co-extruded then heat shrunk, the hygroscopic component wants to elongate. However, this is restricted by the non-hygroscopic component resulting in the helix structure. On exposure to humidity, the hygroscopic component wants to further elongate. Again, this action is resisted by the non-hygroscopic component and the stiffer non-hygroscopic component causes the helix angle to tighten. This results in the activated configuration shown in FIG. 6*b*. Compared with the fibre in relatively dry conditions, the width a is reduced and the length b is reduced. On removal of the trigger, the active shape-memory fibre returns to its unactivated configuration shown in FIG. 6*a*. Typically, the length b may be reduced by 20% and the width a reduced by 10% in 100% humid conditions compared with dry conditions.

Alternatively, the fibre may be straight before exposure to humidity and becoming twisted on exposure to humidity. In this case, the characteristic of reducing in dimension would depend on how the fibres are incorporated into the yarn or fabric.

In one embodiment, a first polymer that has a relatively high moisture swelling rate, such as nylon 6, and a second polymer that has a relatively low moisture swelling rate, such as polypropylene (PP), are fed into the separate polymer distribution systems. The polymers typically are selected to have melting points such that the polymers can be spun as a polymer throughput that enables the spinning of the components through a common capillary at substantially the same temperature without degrading one of the components. A bi-component fibre, in an eccentric sheath/core embodiment, was thus prepared, using the PP as a core fibre component.

The bi-component fibre was prepared using a known extruding apparatus, with a granular PP fed into one extruder and a granular nylon 6 fed into a second extruder. The bi-component fibre was extruded at a temperature of 280° C., with the PP inner fibre component comprising 30% of the bi-component fibre's cross-section and the nylon 6 outer fibre component comprising 70% of the bi-component fibre's cross-section. The bi-component fibres were spun at a rate of 1,150 meters/minute and subsequently drawn to a linear density of 2.4 denier per filament. The drawn fibres were crimped, dried, and cut for subsequent processing into spun yarns and knit fabrics.

In tests, when exposed to 90% relative humidity at 25° C., loose staple fibres increase the angle of crimp and reduce in length by approximately 25% after 10 min. then return to original state when dry. This can be seen in FIGS. 7*a* and 7*b* where the length of the loose bundle has reduced from 9.29 mm, dimension c, FIG. 7*a* to 7.09 mm, dimension c, FIG. 7*b*.

The active staple fibres can be spun into yarn structure using a variety of known methods, such as Air jet or Murata Jet Spinning (MJS), Ring Spinning, Core Spinning and more complex fancy or yarn structures or configurations. Yarns can be composed of 100% active fibre or in a blend with other fibres. Examples of spun fibres 80*a*, 80*b*, and 80*c* can be seen in FIGS. 8*a*-8*c*. In FIG. 8*a* staple active fibres 82 are bundled together and bound with a longer staple or filament fibre 84 to produce yarn 80*a*. Fibre 84 may be an active fibre or a neutral fibre. Further, fibre 84 may be a bundle of fibres. The active fibres 82 are not completely wrapped in the binding fibre 84 so that they are free to react to the stimulus. In FIG. 8*b* active staple fibres are bound around filament or longer staple support fibres 84 to produce 80*b*. In FIG. 8*c*, yarn 80*c* consists of a bundle of generally aligned staple active fibres 82 held together with a longer active fibre 84. The neutral fibres assist the yarns in having a stable length, while the active fibres are exposed to the environment. The skilled person will realise that these yarns are not limited and the fibres may be spun using a number of known methods to produce yarns with different behaviours and textures in fabrics or textiles.

MJS and ring spun yarns using 100% active fibres and ring spun yarns using 50:50 blends of active fibres with TENCEL and wool have been made and woven into fabric and tested. The results can be seen in FIG. 9 which compares non-active fabrics and fabrics made from active yarns. The x-axis shows relative humidity where 1.0=100% relative humidity. The y-axis shows air flow resistance, normalised by value at 0% relative humidity. In general the non-active fabrics show very little change in air flow as humidity increases (polyester non-woven) or increase in air flow resistance as humidity increases (wool non-woven and cotton woven), whereas, the active fabrics decrease in air-flow resistance.

A common cotton woven fabric 1002 represented by triangles showed a marked increase of resistance of air flow with increased humidity and as the humidity approached 100% the air flow was reduced by 75%. A common woollen felt or non-woven material 1004 represented by solid circles also showed increased resistance to air flow with increasing humidity. A common polyester fabric 1006 represented by solid squares showed little change in air flow resistance with changing humidity. Whereas, the fabrics made from active fibres showed decrease in air flow resistance with increasing humidity. The results represented by open squares correspond to a ring spun plain weave fabric 1008 made from 100% active fibres. This fabric showed a decrease in air flow resistance of approximately 17% as the humidity was increased to 100%. The results represented by a solid line correspond to a MJS woven fabric 1010 made from 100% active fibres. This fabric showed a decrease in air flow resistance of approximately 20%.

In moisture controlled air permeability tests the effect was found to be reversible. When exposed to 90% relative humidity for 1 hour the active yarns reduce the thickness of their cross sections between 8-17%. When the humidity was decreased, the yarns returned to the dry unactivated configuration and performance.

A woven active textile sample using either MJS or ring spun yarn will reduce its resistance to air flow in high humidity by 20-25%.

FIGS. 10*a* and 10*b* show an example of a knitted active fabric. In FIG. 10*a*, an active yarn 10 has been knitted. In FIG. 10*a* the fabric is in humid conditions. The yarns 10 are relatively narrow and the spaces 24 are large. In FIG. 10*b* the fabric is in dry conditions. The yarns 10 are relatively broad and the spaces 24 are smaller.

Active woven fabric 20 has already been described with reference to FIGS. 2*a* and 2*b*.

In FIG. 11 the active fibres 60 have been bonded together at points 1102 to produce a mesh of fibres, thus forming a non-woven fabric. As with fabrics formed from active yarns, the fibres decrease in width in humid conditions, thus increasing the air flow through the fabric.

Yarns and fabrics can be further processed using mechanical treatments, for example, pressing, or pleating, and or chemical treatments such as dyeing, coating, printing, and adding functional finishes.

The skilled person will realise that active fibres may be advantageously combined with moisture wicking fibres for sport clothing, for example. Moisture wicking fibres are intended to draw moisture from perspiration away from the body of the wearer. If combined with active fibres, moisture would also escape from the body through the increased permeability of the active fabric, thus, increasing the speed of removing moisture trapped between the garment and body and maintaining comfort for the wearer.

Further, the skilled person will realise that active fibres will assist in cleaning of textiles. Soiling of textiles is in part caused by debris becoming trapped in between the yarns or fibres of the textile. The density of the yarns or fibres means that it is difficult for the debris to escape. On cleaning in water active fibres which, at least in part, make up a textile will be at their most compact, thus, it will be easier for debris to escape from the textile through the increased spaces between yarns and fibres.

Textiles have a large number of uses and active textiles such as those described herein may be usefully used in circumstances where a common textile would otherwise be used. These include but are not limited to garments and textiles for clothing, agricultural textiles, building textiles, geo-textiles, domestic or industrial interior textiles, domestic or industrial cover textiles, filters, medical textiles, medical dressing textiles, packaging, and vehicle interior/exterior textiles.

The skilled person will realise that the embodiments described herein are not limited and that active fibres, yarns and fabrics/textiles could be produced using fibres made from polymers displaying suitable properties relative to one another and in different trigger environments. Further, the fibres may display different behaviour to achieve the desired effect, and can be one-use, that is, activatable once or a limited number of times.

The invention claimed is:

1. A fabric for use as clothing, comprising:

a plurality of shape-memory active fibers and small gaps formed between the shape-memory active fibers;

wherein each one of the shape-memory active fibers includes a sheath formed of a first extruded material, and a core formed of a second extruded material, the core being coextended with the sheath, the core being located inside the sheath, the core being eccentric and off-center relative to the sheath, and the first extruded material being different from the second extruded material, and wherein the first extruded material and the second extruded material respond differently to an external stimulus:

wherein each one of the shape-memory active fibers has (1) a first helical configuration in an unactivated state and (2) a second helical configuration, with a decreased radius and pitch relative to the first helical configuration, in an activated state, and wherein, in the first helical configuration, the shape-memory active fibers are long relative to the second helical configuration, and, in the second helical configuration, the shape-memory active fibers are short relative to the first helical configuration, and wherein each one of the shape-memory active fibers changes from the first helical configuration to the second helical configuration, with the decreased radius and pitch, in response to increased humidity;

wherein each one of the shape-memory active fibers changes from the second helical configuration to the first helical configuration in response to reduced humidity, and wherein each one of the shape-memory active fibers moves reversibly between the active state and the unactivated state in proportion to humidity as the external stimulus, such that the small gaps change in size in proportion to the external stimulus such that air flow resistance and air permeability of the fabric decreases and increases, respectively, in response to increased humidity, and increases and decreases, respectively, in response to decreased humidity; and wherein the first extruded material is from 70% to 80% by volume Nylon 6, and the second extruded material is from 20% to 30% by volume polypropylene.

2. The fabric according to claim 1, wherein the shape-memory active fibers have rectangular, oval, circular, or tri-lobal cross-sections.

3. The fabric according to claim 2, further comprising first yarns and second yarns, wherein the first yarns and the second yarns include other fibers, and wherein the other fibers are different from the shape-memory active fibers.

4. The fabric according to claim 2, further comprising first yarns and second yarns, and wherein the first yarns and the second yarns include moisture-wicking fibers.

5. The fabric according to claim 2, wherein the fabric is a non-woven fabric in which the shape-memory active fibers are bonded together to form a mesh of shape-memory active fibers.

6. A garment comprising the fabric of claim 1.

7. A knitted or woven fabric for use as clothing, comprising:

first yarns extending in a first direction; and second yarns extending in a second direction, the first yams and the second yarns being knitted or woven together such that small gaps are defined between the first yarns and the second yarns; and wherein each one of the first yarns and/or each one of the second yarns includes a plurality of shape-memory active fibers;

wherein each one of the shape-memory active fibers includes a sheath formed of a first extruded material, and a core formed of a second extruded material, the core being coextruded with the sheath, the core being located inside the sheath, the core being eccentric and off-center relative to the sheath, and the first extruded material being different from the second extruded material, and wherein the first extruded material and the second extruded material respond differently to an external stimulus;

wherein each one of the shape-memory active fibers has (1) first helical configuration in an unactivated state and (2) a second helical configuration, with a decreased radius and pitch relative to the first helical configuration, in an activated state, and wherein, in the first helical configuration, the shape-memory active fibers are long relative to the second helical configuration, and, in the second helical configuration, the shape-memory active fibers are short relative to the first helical configuration, and wherein each one of the, shape-memory active fibers changes from the first helical configuration to the second helical configuration, with the decreased radius and pitch, in response to increased humidity;

wherein each one of the shape-memory active fibers changes from the second helical configuration to the first helical configuration in response to reduced humidity, and wherein each one of the shape-memory active fibers of the first yarns and/or each one of the second yarns moves reversibly between the active state and the unactivated state in proportion to humidity as the external stimulus, such that the small gaps between the first yarns and the second yarns increase in size in response to an increase in humidity and decrease in size in response to a decrease in humidity, and such that air flow resistance and air permeability of the knitted or woven fabric decreases and increases, respectively, in response to increased humidity, and increases and decreases, respectively, in response to decreased humidity; and wherein the first extruded material is from 70% to 80% by volume Nylon 6, and the second extruded material is from 20% to 30% by volume polypropylene.

8. The fabric according to claim 7, wherein the shape-memory active fibers have rectangular, oval, circular, or tri-lobal cross-sections.

9. The fabric according to claim 8, wherein the first yarns and the second yarns include other fibers, and wherein the other fibers are different from the shape-memory active fibers.

10. The fabric according to claim 8, wherein the first yarns and the second yarns include moisture-wicking fibers.

11. A garment comprising the fabric of claim 7.

* * * * *